US007997263B2

(12) United States Patent
Berkenkoetter et al.

(10) Patent No.: US 7,997,263 B2
(45) Date of Patent: Aug. 16, 2011

(54) METHOD FOR CONTROLLING THE EXHAUST FLOW FROM A COOKING CHAMBER OF A BAKING OVEN

(75) Inventors: Herbert Berkenkoetter, Oelde (DE); Thomas Kruempelmann, Guetersloh (DE); Ulrich Sillmen, Guetersloh (DE)

(73) Assignee: Miele & Cie. KG, Guetersloh (DE)

( * ) Notice: Subject to any disclaimer, the term of this patent is extended or adjusted under 35 U.S.C. 154(b) by 909 days.

(21) Appl. No.: 11/851,474

(22) Filed: Sep. 7, 2007

(65) Prior Publication Data

US 2008/0066732 A1 Mar. 20, 2008

(30) Foreign Application Priority Data

Sep. 14, 2006 (DE) ..... 10 2006 043 933

(51) Int. Cl.
*F24C 15/32* (2006.01)

(52) U.S. Cl. ..... 126/21 A; 126/21 R

(58) Field of Classification Search ..... 126/21 A, 126/21 R, 285 R; 236/1 G, 15 A, 44 C
See application file for complete search history.

(56) References Cited

U.S. PATENT DOCUMENTS

| | | | | |
|---|---|---|---|---|
| 3,625,135 | A * | 12/1971 | Carlson | 126/299 D |
| 4,954,694 | A * | 9/1990 | Nagai et al. | 219/413 |
| 6,462,319 | B1 * | 10/2002 | Uy et al. | 219/681 |
| 6,781,258 | B2 * | 8/2004 | Hashimoto | 307/87 |
| 6,913,012 | B2 * | 7/2005 | Divett et al. | 126/21 A |
| 6,920,874 | B1 * | 7/2005 | Siegel | 126/299 R |
| 2004/0129800 | A1 * | 7/2004 | Duquet | 239/327 |

FOREIGN PATENT DOCUMENTS

| | | |
|---|---|---|
| DE | 2925947 | 1/1981 |
| DE | 3804678 | 8/1989 |
| DE | 10211522 | 9/2003 |
| EP | 1156282 | 11/2001 |
| EP | 1156282 A1 * | 11/2001 |

* cited by examiner

*Primary Examiner* — Kenneth B Rinehart
*Assistant Examiner* — Chucka C Ndubizu
(74) *Attorney, Agent, or Firm* — Leydig, Voit & Mayer, Ltd.

(57) ABSTRACT

A baking oven and method for controlling the exhaust flow from a cooking chamber of the baking oven. The exhaust flow is discharged from the oven by a fan. The method includes increasing the speed of the fan and measuring the gas concentration of the cooking chamber during a first time interval. The gas concentration is measured using a gas sensor. At the beginning of the first time interval, an initial gas concentration is measured. During the first time interval a fan speed is selected at which the measured gas concentration varies from the initial gas concentration. The speed of the fan is set for a second time interval as a function of the selected fan speed from the first time interval.

17 Claims, 5 Drawing Sheets

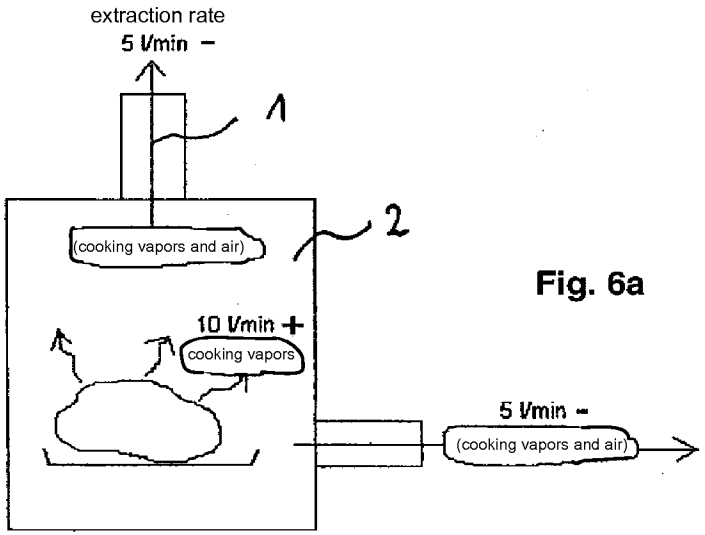
Fig. 6a
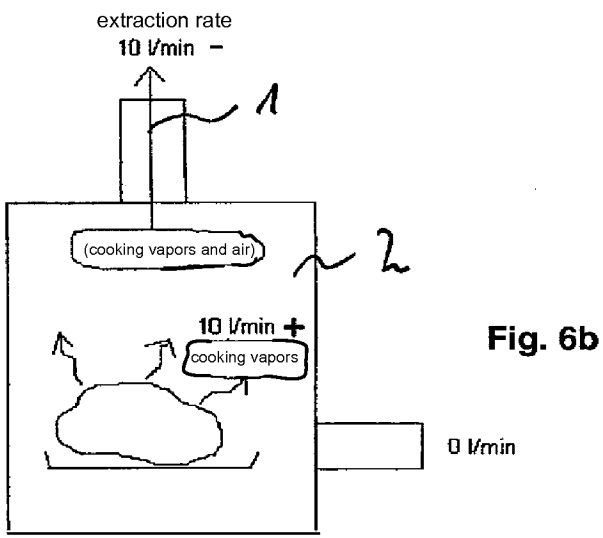
Fig. 6b
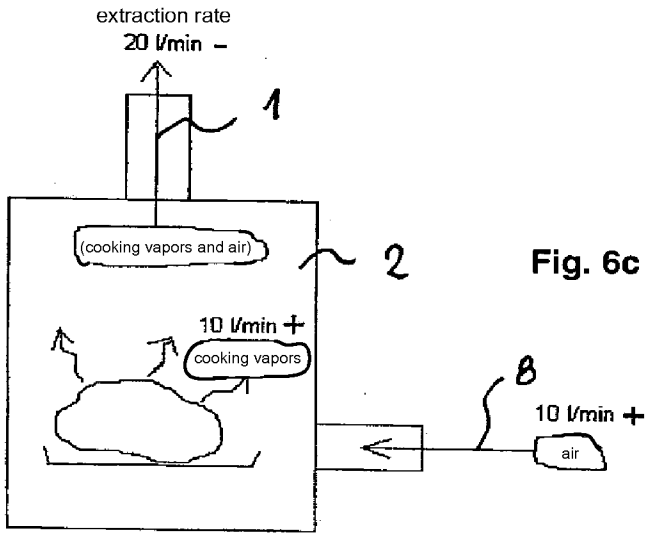
Fig. 6c
Fig. 6

METHOD FOR CONTROLLING THE EXHAUST FLOW FROM A COOKING CHAMBER OF A BAKING OVEN

Priority is claimed to German patent application DE 10 2006 043 933.3, filed Sep. 14, 2006, and which is hereby incorporated by reference herein.

The present invention relates to a method for controlling the exhaust flow from a cooking chamber of a baking oven, the exhaust flow being discharged to the environment by a fan whose speed is controlled as a function of a gas concentration in the cooking chamber of the baking oven, said gas concentration being measured by a gas sensor.

BACKGROUND

Baking ovens with cooling fans, on the one hand, protect sensitive components, especially electronic controllers and parts in the vicinity, from overheating and, on the other hand, remove excess steam from the cooking chamber. They also prevent excessive concentrations of steam in the cooking chamber and also prevent outflow of steam at sites of leakage. Since different types of baked goods generate different volumes of steam at comparable temperatures, and because steam condensates on cooler surfaces in a manner which strongly depends on the present condition, especially of the baking oven wall, previously used methods of controlling the cooling fan based on the heating power of the oven, or the inside temperature thereof, are not satisfactory.

German Patent Application DE 38 04 678 A1, for example, describes a method for controlling the exhaust flow from a cooking chamber. The exhaust fan is controlled as a function of the humidity measured in the vapor exhaust duct during the cooking process.

German Patent Application DE 102 11 522 A1 describes that the speed of a fan for generating an air flow in the cooking chamber can be adjusted between zero and a maximum speed to thereby control the extraction of air from the cooking chamber. It is proposed to use an oxygen sensor for purposes of controlling the exhaust air volume.

Furthermore, German Patent DE 29 25 947 C2 describes the general relationship that a measured value is obtained in a first time interval, and the controlling variable determined therefrom is used in a subsequent second time interval.

In order to control the exhaust flow rate by fan speed control in a manner that is adapted to the cooking process, it is proposed in EP 1 156 282 to measure, as a control parameter, at least one physical parameter which varies with the pressure difference between the interior of the oven and its environment. This ensures that the fan speed is controlled in a manner that is adapted to the specific cooking process. To this end, the temperature is measured during a period of time, a predetermined setpoint being provided which, when exceeded by the temperature, causes the fan speed to be adjusted upward to the point where the temperature falls below a predetermined setpoint. When another temperature change occurs above the upper setpoint, the control of the fan is increased again, and so on.

In this fan speed control method the fan speed is dependent on the heating temperature in the oven, the temperatures being adjusted downward by the discharge or exhaust flow in a suitable manner, so that the resulting temperature variation during the cooking process occurs between a lower and an upper setpoint.

This type of fan speed control is believed to have the disadvantage that speed control is performed continuously, which, in particular, ties up computing power in the controller.

In order for an appliance to operate in an optimal manner, the extraction of cooking vapors from the cooking chamber must be performed in such a way that no cooking vapors exit the cooking chamber at unwanted sites, air intake openings, leaks, due to positive pressure. The cooking vapors are intended to be discharged from the baking oven by flow-rate controllable extraction only through the vent that is provided for this purpose and, if present, through the oxidation catalyst located therein. To achieve this, a minimum extraction rate is required. A sensor system, as described, provides information on the extraction rate required for this purpose. The lower the extraction rate, the lower are the energy losses of the cooking appliance. In prior art methods, the required extraction power is generally not adequately adjusted to the demand. Realization that the fan speed is correlated with the baking oven temperature is described in EP 1 156 282. In this context, it is assumed that the amount of cooking vapors produced in the oven chamber at high temperatures is greater than at low temperatures, and that, therefore, a higher extraction rate is required at high temperatures. However, there is no close correlation with the actual demand.

SUMMARY

It is, therefore, an object of the present invention to provide a method for controlling the exhaust flow from a cooking chamber of a baking oven which is closely correlated with the demand and which does not require an additional opening in the cooking chamber.

In an embodiment, the present invention provides a method for controlling the exhaust flow from a cooking chamber of a baking oven. The exhaust flow is discharged from the oven by a fan. The method includes increasing the speed of the fan and measuring the gas concentration of the cooking chamber during a first time interval. The gas concentration is measured using a gas sensor. At the beginning of the first time interval, an initial gas concentration is measured. During the first time interval a fan speed is selected at which the measured gas concentration varies from the initial gas concentration. The speed of the fan is set for a second time interval as a function of the selected fan speed from the first time interval.

In another embodiment, the present invention provides a baking oven which controls the exhaust flow from a cooking chamber therein. The baking oven includes a fan for discharging the exhaust flow. A gas sensor is also included and configured to measure a gas concentration of the cooking chamber during a first time interval of the baking process. Also included is an electronic controller, which is configured to increase the speed of the fan during the first time interval. The electronic controller is also configured to select a fan speed at which the measured gas concentration varies from an initial gas concentration measured at the beginning of the first time interval. The electronic controller is further configured to set the fan speed during a second time interval as a function of the selected fan speed.

BRIEF DESCRIPTION OF THE DRAWINGS

The present invention will be explained, based on exemplary embodiments, in more detail with reference to the following FIGS. 1 through 8, of which:

FIG. 6 shows examples of different flow conditions resulting from vapor formation, vapor extraction, and fresh air;

DETAILED DESCRIPTION

Figure 1:
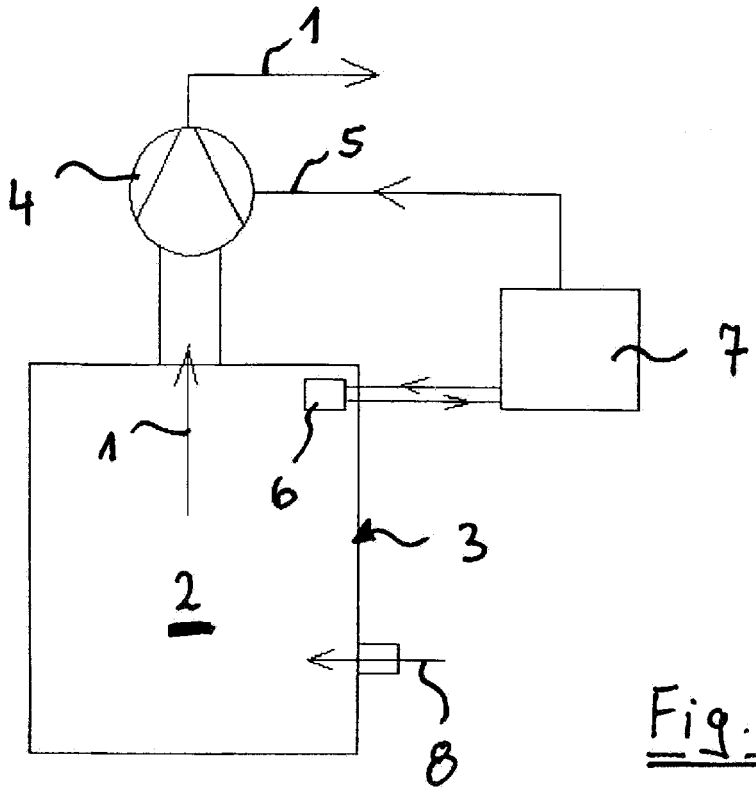
FIG. 1 is a first block diagram illustrating the control of the exhaust flow from a cooking chamber of a baking oven.

The present invention proposes a method in which, in order to control the fan speed, the pressure conditions in the cooking chamber can be inferred from analysis of a gas sensor signal and a special control of the cooking vapor exhaust fan. This is possible because cooking vapors are produced in different specific quantities, depending on the food to be cooked and on the point in time in the cooking process. Cooking vapors are in the form of a gas or aerosol and are produced by heat treatment, or more generally, by energy supply from the previously liquid and solid components of the food being cooked. These additional gases produce a slight positive pressure in the cooking chamber, as a result of which they tend to exit through any openings that may be available, such as leaks. If the extraction is adjusted to demand, the cooking vapors are extracted through the exhaust air port at a rate which, on the one hand, is just sufficient to prevent cooking vapors from exiting through any other desired or unintended air openings of the oven, and which, on the other hand, causes dry ambient kitchen air to be drawn into the cooking chamber. In order to determine the extraction rate required at a particular point in time, the extraction rate is varied in intervals. When starting at a low extraction rate, the cooking vapor signal does not change as long as no dry ambient kitchen air is drawn into the cooking chamber through the air intake openings. To this end, initially, the gas concentration is measured in a first time interval, whereupon a speed for the fan is determined therefrom in an electrical controller of the baking oven. The concentration of cooking vapors does not begin to decrease until extraction takes place at a rate sufficient to cause dry ambient kitchen air to be drawn into the cooking chamber. Then, the speed is maintained constant during a subsequent second time interval, in which no gas concentration is measured. When said time interval ends, a further first time interval follows in which the gas concentration is measured. It may then be significantly lower, so that the fan speed will be reduced in the following second time interval, until a further gas concentration measurement is made during a new first time interval. Subsequently this new first time interval will be followed by a further second time interval during which the fan will proceed at a constant, possibly further reduced speed.

The respective time intervals are alternatingly repeated during the cooking process, the second time interval being longer than the first one, so that the fan control occurring during the cooking process produces an exhaust flow which causes the cooking vapors to be extracted in a manner that is adjusted to demand. The degree of vapor extraction at a point which is just sufficient to cause dry ambient kitchen air to be drawn into the cooking chamber is used as an orientation threshold for this second time interval, which may have a duration of several minutes. Optionally, the electronics may have stored therein an equation or a table which implements the actual cooking vapor extraction for the respective second time interval as a function of said threshold. This may be, for example, at the identified threshold, or slightly below or above it. After the second time interval, the measurement and analysis cycle is restarted for a further first time interval in order to determine the extraction rate required for the next second time interval, and so on.

When plotting, for example, the exhaust flow rate and/or the fan speed, against time, then a minimum low threshold value is obtained for the extraction, zero extraction also being possible, which is raised during the gas concentration measurement phase until a fan speed is reached which is just sufficient to cause ambient kitchen air to be drawn into the cooking chamber, which results in an upper threshold at which the fan speed is then maintained constant during the second time interval, said second time interval having a defined duration, until a new first time interval begins in which the gas concentration is measured. This results in alternating threshold values, so that the extraction takes place over time in a manner that is adjusted to demand.

In principle, it is possible to vary the fan speed through the entire fan speed range from low to maximum during the first time interval. However, it is convenient to terminate the first time interval when the above-mentioned threshold value for the fan speed, i.e., the orientation threshold for the second time interval, is reached.

The duration of the first time interval is selected to be so short that the gas concentration in the cooking chamber remains substantially constant during the first time interval, given a constant exhaust flow rate. During the first time interval, the fan speed is automatically increased in a continuous or stepwise manner, starting from a low speed at which only part of the vapors produced during the cooking process is discharged by the fan to the environment, until the gas sensor measures a gas concentration which is different from an initial gas concentration measured at the beginning of the first time interval, and the fan speed is automatically set for the second time interval as a function of the last speed.

In one embodiment of the present invention, the gas sensor is in the form of an oxygen sensor which measures, as a gas concentration, the oxygen concentration in the cooking chamber. In a refinement, the gas sensor measures, as a gas concentration, the concentration of a gas produced by the cooking process in the cooking chamber. If, for example, oxygen is measured in the cooking chamber in place of the cooking vapors, the concentration will also initially remain at a constant level, given a low extraction rate. However, at a higher extraction rate at the threshold, it will begin to increase and not decrease as would be the case with cooking vapors. The oxygen signal begins to increase once a point is reached where, due to the extraction, there are no more cooking vapors escaping through the air intake openings, but oxygen is drawn in from the ambient kitchen air. That is, what happens during oxygen measurement is just the opposite of what occurs when measuring the concentration of cooking vapors or of humidity.

FIG. 1 shows, in a block diagram, the control of an exhaust flow 1 from a cooking chamber 2 of a baking oven 3 to the environment, which flow control is provided by a fan 4. In the process, speed 5 is controlled as a function of a gas concentration in cooking chamber 2 of baking oven 3, said gas concentration being measured by a gas sensor 6. To this end, electronics 7 are provided between fan 4 and sensor 6, said electronics processing the sensor signals for speed control purposes. Fresh air 8 may enter cooking chamber 2 due to leaks.

Figure 2:
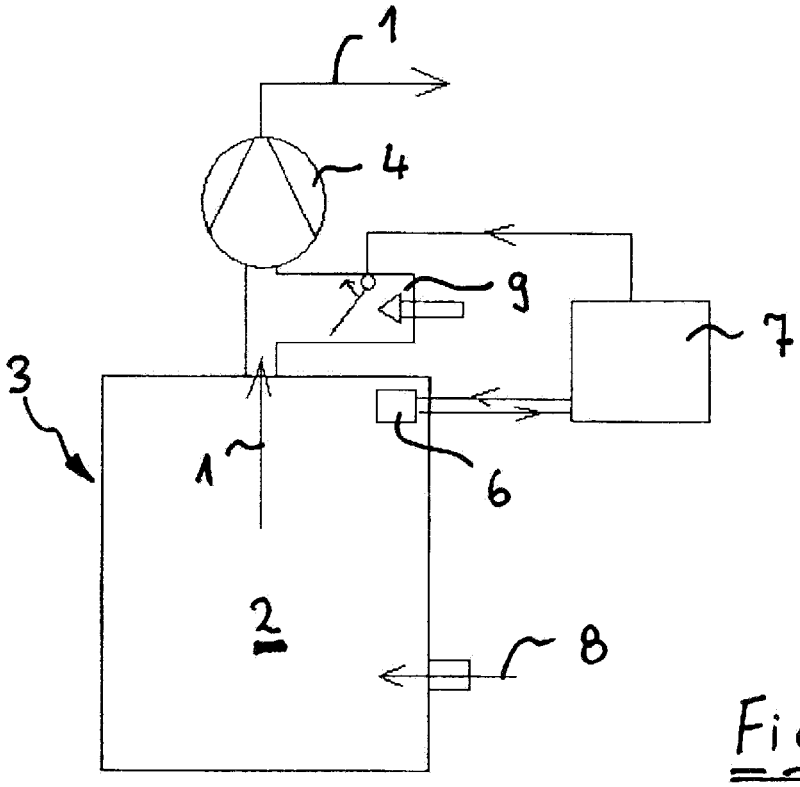
FIG. 2 shows another embodiment which is similar to that of FIG. 1, but has a damper control.
Figure 3:
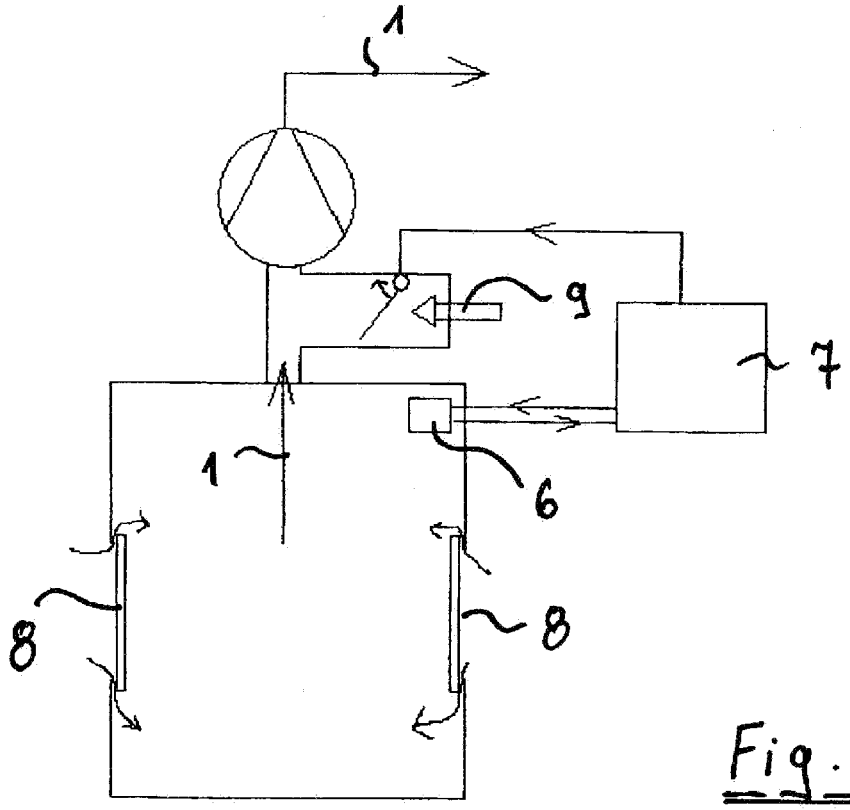
FIG. 3 shows a further embodiment which is similar to those shown in FIGS. 1 and 2.

Electronics 7 for varying the rate of exhaust flow 1 may be used, for example, to control the speed of fan 4 or the cross sectional area of the opening of a bypass damper 9 on the intake side of fan 4, as is shown in FIG. 2. An air intake opening 8 may be a structural opening through which dry ambient kitchen air can be drawn into cooking chamber 2 during the extraction of cooking vapors from cooking chamber 2. However, air intake opening 8 may also be one or more almost inevitable air leaks 8 in baking oven 3, such as gaps in the region of the door or in the region of the lamp seal, or at the penetrations for heaters, food thermometers, or the like. This is shown especially in FIG. 3.

Figure 4:
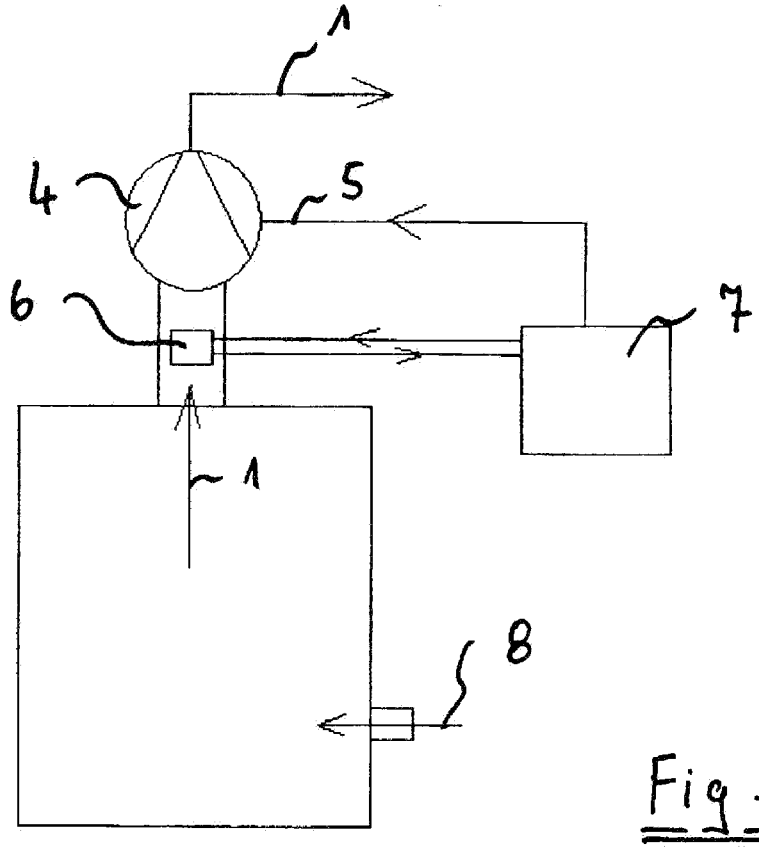
FIG. 4 shows yet another embodiment which is similar to that of FIG. 1, but in which the sensor is disposed in the air exhaust passageway.

Another variant is shown in FIG. 4, where gas sensor 6 is disposed in particular in the air exhaust passageway.

Figure 5:
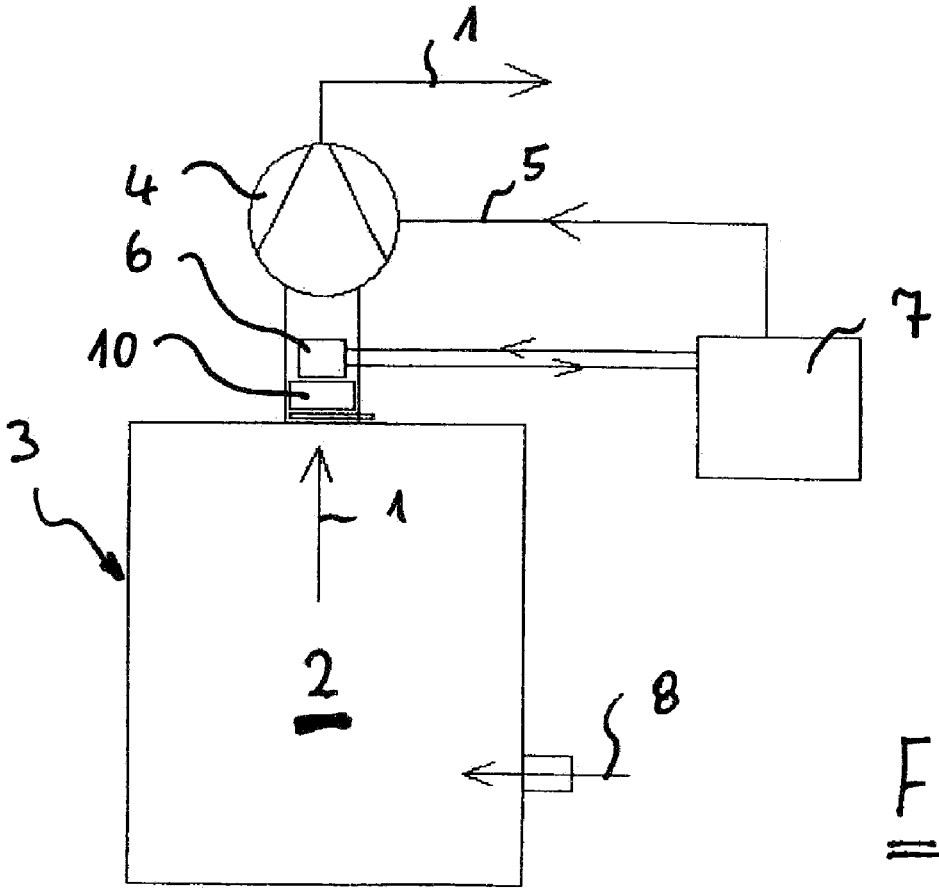
FIG. 5 shows a further embodiment which is similar to that of FIG. 4, but in which the sensor is disposed downstream of an exhaust catalyst.

FIG. 5 differs from FIG. 4 only in that gas sensor 6 is located downstream of an exhaust catalyst 10, or downstream of a heatable exhaust catalyst or a temperature-controlled exhaust catalyst.

Figure 8:
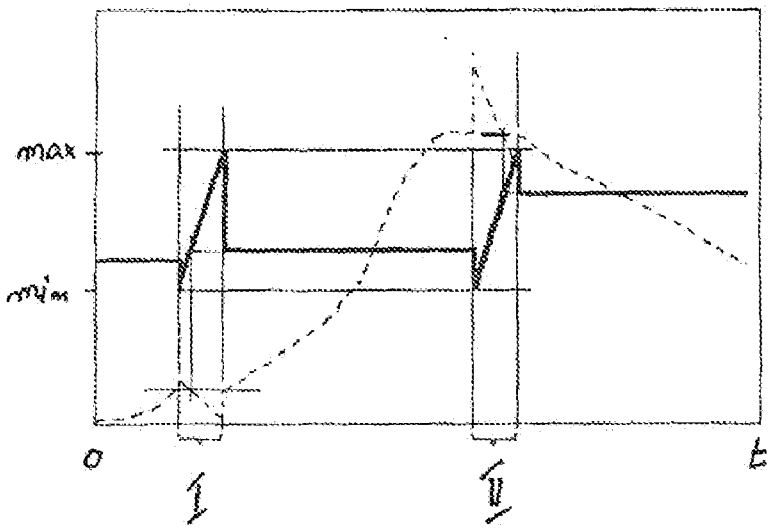
FIG. 8 is a graphical representation over time of measurement cycles for determining the required fan speed.

In accordance with the method of the present invention illustrated in FIG. 8, in a first time interval, the system measures the gas concentration (dashed line) and varies the speed (solid line) of fan 4, as shown in FIG. 8, for example, for the case where a small amount of cooking vapors is produced. As a result of the measurements, the fan speed for the subsequent second time interval is automatically determined therefrom and set in an electrical controller 7 of baking oven 3.

In the subsequent second time interval, the so-determined speed of fan 4 is maintained substantially constant. Both time intervals, one with varying speed and one with constant speed, are alternatingly repeated during the cooking process, the second time interval being longer than the first time interval. Thus, FIG. 8 shows a time history of the emission of cooking vapors from the food (dashed line), which is approximately similar to the variation of humidity emission with time, or to the decrease in $O_2$ concentration with time. The variation with time of the relevant fan speed is shown in the diagram as a solid line. Above the time axis, two measurement cycles I and II are shown during which the fan speed required for the subsequent second time interval is determined, For each second time interval, the fan speed is required until the next measurement cycle, respectively.

For the functioning of the method, it is assumed that in each measurement cycle for determining the required fan speed, the variation with time of the vapor extraction rate caused by the change in the fan speed is large compared to the variation in the amount of cooking vapors emitted from the food per unit time, or compared to the variation in the oxygen concentration which decreases per unit time as a function of the cooking vapors produced. This assumption is generally satisfied since processes of alteration in the food during cooking typically occur slowly, while the fan speed can be changed relatively rapidly during the first time interval.

Before a measurement interval, i.e., a first time interval, starts, an amount per unit time of cooking vapors released from the food is measured (for the last time before the fan speed is changed). As described above, it is assumed that this amount per unit time of cooking vapors from the food, and thus the gas concentration, remains sufficiently constant during the measurement cycle, given a constant exhaust flow rate. The fan speed (solid line) is changed, for example, from minimum to maximum. The fan speed at which, for the first time, the concentration of cooking vapors, or the concentration of humidity, begins to decrease below the last measured value, or at which, for the first time, the oxygen concentration begins to increase above the last measured value before the measurement cycle, is a reference value for the required fan speed, illustrated in FIG. 8 in measurement cycle I by the projection line. In order to reliably detect the first occurrence of a decrease or increase, it is convenient, though not necessary, to pass slightly beyond that point. This generally occurs automatically when passing through the minimum-maximum range for the fan speed and, respectively, for the exhaust flow rate.

After measurement cycle I, the desired fan speed is then fixed for a subsequent period with respect to the so-determined extraction power until a new value is determined in a further measurement cycle, here measurement cycle II.

Depending on the purpose, the desired fan speed may be exactly at the point where, for the first time, the measured value of the emission of cooking vapors per unit time begins to decrease below the value before the measurement cycle (desired fan speed=reference value). However, it may also be selected to be slightly higher (desired fan speed>reference value) or lower (desired fan speed<reference value), such difference being, for example, a stored percentage of the reference value (for example, +10% or −10%).

This design especially saves computing power because the gas concentration is only measured in the shorter first time interval, here measurement cycles I and II.

The duration of the first time interval is selected to be so short that the gas concentration in cooking chamber 2 remains substantially constant during the first time interval, given a constant exhaust flow rate. As can be appreciated in FIG. 8, the speed of fan 4 is automatically increased during the first time interval in a continuous or stepwise manner, starting from a low speed (low threshold value) at which only part of the vapors produced during the cooking process is discharged by fan 4 to the environment, until gas sensor 6 measures a gas concentration which is different from an initial gas concentration measured at the beginning of the first time interval. The speed of fan 4 is automatically set for the second time interval as a function of the last speed, and is maintained constant during the second time interval. When the second time interval has elapsed, measurement restarts with the first time interval, in which, in particular, the gas concentration is measured.

It is understood that when gas sensor 6 is in the form of an oxygen sensor which measures, as a gas concentration, the oxygen concentration in cooking chamber 2, a different curve will be obtained because the oxygen concentration in oven chamber 3 decreases as the cooking process proceeds. The oxygen signal begins to increase once a point is reached where, due to the extraction, there are no more cooking vapors escaping through air intake openings 8, but oxygen is drawn in from the ambient kitchen air. Then, a new first time interval begins in which, in particular, the gas concentration is measured. In an advantageous refinement, gas sensor 6 measures the gas concentration of a gas produced by the cooking process in cooking chamber 2.

FIG. 6 shows examples of different flow conditions resulting from vapor formation, vapor extraction, and fresh air; FIGS. 6*a* and 6*b* showing the case where the cooking vapors are not diluted by fresh air 8, the measured concentrations of cooking vapors being the same in both cases. On the other hand, FIG. 6*c* shows the case where the cooking vapors are diluted by fresh air 8, resulting in a lower concentration of cooking vapors, or of humidity, or, respectively, a higher concentration of oxygen, in cooking chamber 2.

Figure 7:
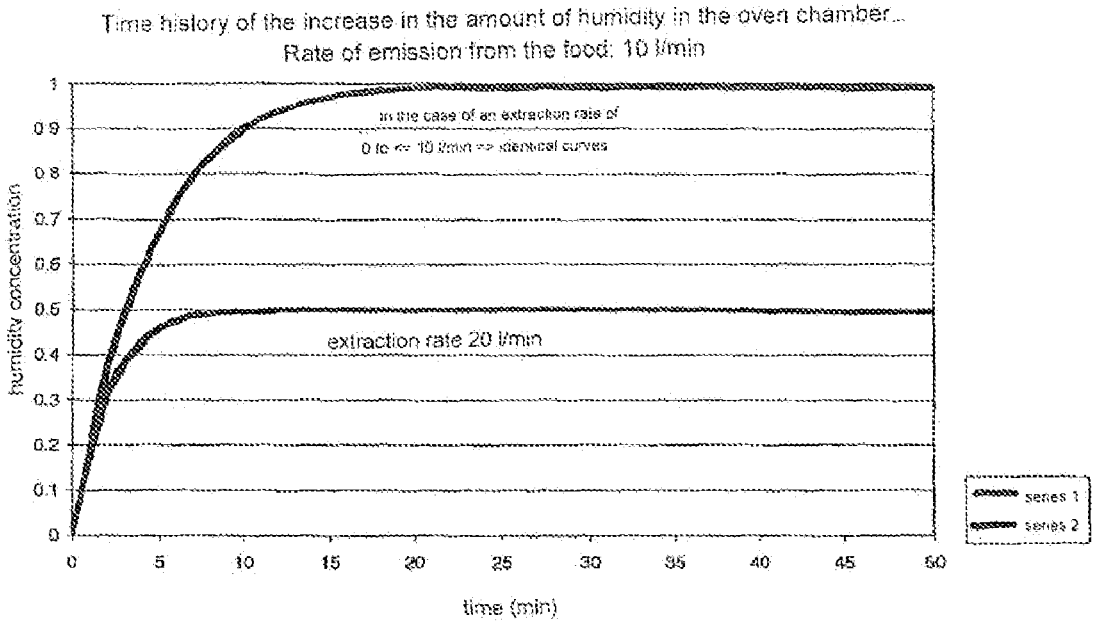
FIG. 7 is a time history of the increase in the amount of humidity in the oven chamber at extraction rates of 10 l/min and 20 l/min.

FIG. 7 shows the time history of the increase in the amount of humidity in the oven chamber at extraction rates of 10 l/min and 20 l/min.

What is claimed is:

1. A method for controlling the exhaust flow from a cooking chamber of a baking oven, the flow being discharged by a fan, the method comprising the steps:

increasing a speed of the fan during a first time interval of a cooking process;

measuring a gas concentration of the cooking chamber using a gas sensor during the first time interval during the increasing of the fan speed;

determining, during the measuring of the gas concentration, a reference fan speed the reference fan speed being the speed of the fan at which the measured gas concentration changes for the first time during the first time interval from an initial gas concentration to a different gas concentration, the initial gas concentration being the measured gas concentration at a beginning of the first time interval; and setting, using an electrical controller, the speed of the fan as a function of the determined reference fan speed during a second time interval.

2. The method as recited in claim 1, further comprising the steps:

increasing the speed of the fan during a third time interval of the cooking process;

measuring the gas concentration of the cooking chamber using a gas sensor during the third time interval;

determining another reference fan speed at which the measured gas concentration during the third time interval changes from an initial gas concentration of the third time interval to another different gas concentration, the initial gas concentration of the third time interval being the measured gas concentration at a beginning of the third time interval.

3. A method for controlling the exhaust flow from a cooking chamber of a baking oven, the flow being discharged by a fan, the method comprising the steps:

increasing a speed of the fan during a first time interval of a cooking process;

measuring a gas concentration of the cooking chamber using a gas sensor during the first time interval;

determining a selected fan speed at which the measured gas concentration varies from an initial gas concentration, the initial gas concentration being the measured gas concentration at a beginning of the first time interval; and setting, using an electrical controller, the speed of the fan as a function of the selected fan speed during a second time interval, wherein the second time interval is longer than the first time interval.

4. The method as recited in claim 1, wherein the set fan speed is within 10% of the reference fan speed.

5. The method as recited in claim 1, wherein the gas sensor is disposed in the cooking chamber.

6. The method as recited in claim 1, wherein the gas sensor is disposed in an air exhaust passageway of the baking oven.

7. The method as recited in claim 1, wherein the speed of the fan is increased during the first time interval continuously.

8. The method as recited in claim 1, wherein the speed of the fan is increased during the first time interval in a stepwise manner.

9. The method as recited in claim 1, wherein the gas sensor includes an oxygen sensor.

10. The method as recited in claim 1, wherein the measured gas concentration is a concentration of a gas produced by the cooking process in the cooking chamber.

11. A baking oven comprising:

a cooking chamber;

a fan for removing exhaust air from the cooking chamber through an exhaust air passageway;

a gas sensor configured to measure a gas concentration of the cooking chamber during a first time interval; and an electrical controller configured to:

increase a speed of the fan during the first time interval, determine, during the measuring of the gas concentration, a reference fan speed, the reference fan speed being a speed of the fan at which the measured gas concentration changes for the first time during the first time interval from an initial gas concentration to a different gas concentration, the initial gas concentration being the measured gas concentration at a beginning of the first time interval, and set the fan speed during a second time interval as a function of the determined reference fan speed.

12. The baking oven as recited in claim 11, wherein the gas sensor is disposed in the cooking chamber.

13. The baking oven as recited in claim 11, wherein the gas sensor is disposed in the exhaust air passageway.

14. The baking oven as recited in claim 11, wherein the gas sensor includes an oxygen sensor.

15. The baking oven as recited in claim 11, wherein the gas sensor is configured to measure a concentration of a gas produced by the cooking process in the cooking chamber.

16. The baking oven as recited in claim 11, wherein the electrical controller is configured to increase the speed of the fan during the first time interval in a stepwise manner.

17. The baking oven as recited in claim 11, wherein the electronic controller is configured to increase the speed of the fan during the first time interval continuously.

* * * * *